US010159886B1

(12) United States Patent
Robertson

(10) Patent No.: US 10,159,886 B1
(45) **Date of Patent: *Dec. 25, 2018**

(54) CONVERTIBLE GOLF ALIGNMENT AND MEASUREMENT DEVICE

(71) Applicant: Peyton Webb Robertson, Fort Lauderdale, FL (US)

(72) Inventor: Peyton Webb Robertson, Fort Lauderdale, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/652,836

(22) Filed: Jul. 18, 2017

(51) Int. Cl.
*A63B 69/36* (2006.01)

(52) U.S. Cl.
CPC ..... *A63B 69/36* (2013.01); *A63B 69/3658* (2013.01); *A63B 69/3667* (2013.01); *A63B 2210/50* (2013.01); *A63B 2225/09* (2013.01)

(58) Field of Classification Search
CPC . A63B 69/36; A63B 69/3658; A63B 69/3667; G01B 3/14; G01B 5/08
USPC .... 473/270, 272, 273, 403, 406, 407; 2/209; 381/379, 383
See application file for complete search history.

(56) References Cited

U.S. PATENT DOCUMENTS 633,307 A 9/1899 Clarkson
895,866 A 8/1908 Kent
1,083,376 A * 1/1914 Robinson ..... G01C 9/28 33/451
1,541,179 A * 6/1925 Parkinson ..... G09B 23/04 33/453
1,593,257 A 7/1926 Hawksworth
1,916,638 A 11/1931 Rizianu
1,887,391 A 11/1932 Aras
2,582,878 A * 1/1952 Metcalf ..... A44C 5/22 63/7
2,640,268 A * 6/1953 Thompson ..... B25H 7/00 33/451
2,790,642 A * 4/1957 Rolfe ..... A63B 69/3667 473/272
3,416,232 A 12/1968 Overbay
3,515,418 A 6/1970 Nielsem, Jr.
3,878,616 A * 4/1975 Arrieta ..... B43L 13/22 269/45
4,745,960 A 5/1988 Karp
5,002,112 A 3/1991 Schnebly
5,010,939 A 4/1991 King
5,662,153 A 9/1997 Rosenblatt
5,881,875 A 3/1999 Beurekjian
6,334,261 B1 1/2002 Scillia et al.
7,967,737 B2 * 6/2011 Watson ..... A63B 5/20 482/139
8,246,482 B1 8/2012 Kim
(Continued)

OTHER PUBLICATIONS

International Search issued in counterpart International Application No. PCT/US2017/042603 dated Sep. 25, 2017.

(Continued)

*Primary Examiner* — Melba Bumgarner
*Assistant Examiner* — Laura L Davison
(74) *Attorney, Agent, or Firm* — Michael T. Abramson; Holland & Knight LLP

(57) ABSTRACT

A golf device including a first elongated portion. The golf device may include a second elongated portion. The golf device may include an arch portion slideably engageable inside the first elongated portion and the second elongated portion.

4 Claims, 11 Drawing Sheets

(56) References Cited

U.S. PATENT DOCUMENTS

| | | | | |
|---|---|---|---|---|
| 8,444,419 | B2 * | 5/2013 | Driskell | G09B 23/04 434/211 |
| 8,864,637 | B2 * | 10/2014 | Leirer | A63B 23/0211 482/121 |
| 9,757,604 | B2 * | 9/2017 | Carter | A63B 5/20 |
| 2007/0238642 | A1 | 10/2007 | Fecue | |
| 2014/0248971 | A1 | 9/2014 | Reid | |
| 2015/0119206 | A1 * | 4/2015 | Newman | A63B 5/20 482/82 |
| 2017/0138125 | A1 | 5/2017 | Adib | |

OTHER PUBLICATIONS

International Search issued in counterpart International Application No. PCT/US2017/042594 dated Sep. 25, 2017.
International Search issued in counterpart International Application No. PCT/US2017/042570 dated Sep. 25, 2017.
International Search issued in counterpart International Application No. PCT/US2017/042584 dated Sep. 21, 2017.
International Search issued in counterpart International Application No. PCT/US2017/042608 dated Sep. 22, 2017.
International Search issued in counterpart International Application No. PCT/US2017/042580 dated Sep. 26, 2017.
Non-Final Office Action issued in counterpart U.S. Appl. No. 15/652,872 dated Sep. 7, 2017.
Non-Final Office Action issued in counterpart U.S. Appl. No. 15/652,894 dated Sep. 22, 2017.
Non-Final Office Action issued in counterpart U.S. Appl. No. 15/652,815 dated Sep. 7, 2017.
Non-Final Office Action issued in counterpart U.S. Appl. No. 15/652,909 dated Oct. 20, 2017.
Non-Final Office Action issued in counterpart U.S. Appl. No. 15/652,865 dated Oct. 19, 2017.
Final Office Action issued in counterpart U.S. Appl. No. 15/652,815 dated Dec. 29, 2017.
Final Office Action issued in counterpart U.S. Appl. No. 15/652,872 dated Jan. 12, 2018.
Final Office Action issued in counterpart U.S. Appl. No. 15/652,909 dated Feb. 22, 2018.
Final Office Action issued in counterpart U.S. Appl. No. 15/652,894 dated Feb. 22, 2018.
Non-Final Office Action issued in U.S. Appl. No. 15/652,815 dated May 2, 2018.
Final Office Action issued in U.S. Appl. No. 15/652,865 dated May 3, 2018.
Non-Final Office Action issued in U.S. Appl. No. 15/652,872 dated May 9, 2018.
Final Office Action issued in U.S. Appl. No. 15/652,815 dated Sep. 12, 2018.
Final Office Action issued in U.S. Appl. No. 15/652,872 dated Sep. 12, 2018.
Non-Final Office Action issued in U.S. Appl. No. 15/652,894 dated Sep. 14, 2018.
Non-Final Office Action issued in U.S. Appl. No. 15/652,909 dated Oct. 3, 2016.

* cited by examiner

CONVERTIBLE GOLF ALIGNMENT AND MEASUREMENT DEVICE

BACKGROUND

The United States Golf Association (USGA) has proposed a new rule (14.3) for measuring in certain circumstances the size of the relief area where a golf ball must be dropped and played, for example, when the previous shot renders the golf ball unplayable. As there may be many additional rules that govern how a ball may be dropped and where a ball may be dropped, questions may arise about whether the ball was dropped near enough to the required drop zone.

BRIEF SUMMARY OF DISCLOSURE

In one example implementation, a golf device may include but is not limited to a first elongated portion. The golf device may include a second elongated portion. The golf device may include an arch portion slideably engageable inside the first elongated portion and the second elongated portion.

One or more of the following example features may be included. The arch portion, when the first elongated portion is separated from the second elongated portion, may be exposed. The golf device may include a securing location at a first end of the first elongated portion and a first end of the second elongated portion. The securing location may include a cavity at the first end of the first elongated portion and an insert at the first end of the second elongated portion, wherein the cavity at the first end of the first elongated portion may be configured to receive the insert at the first end of the second elongated portion. The first elongated portion and the second elongated portion may form a 90 degree angle at the securing location. The arch portion may include a first slideable end slideably engageable inside the first elongated portion until a second end of the first elongated portion is reached. The arch portion may include a second slideable end slideably engageable with the second elongated portion until a second end of the second elongated portion is reached. The arch portion, when the first slideable end reaches the second end of the first elongated portion, and when the second slideable end reaches the second end of the second elongated portion, may create a radius with a length from the securing location to the arch portion. The length may be 20 inches. The arch portion may include a keeper slideably engageable with the first elongated portion, and wherein the second end of the first elongated portion may include a stop. The golf device may include interlocking rings coupled to the keeper and a first end of the arch portion.

In another example implementation, a golf device may include but is not limited to a first elongated portion. The golf device may include a second elongated portion. The golf device may include an arch portion slideably engageable inside the first elongated portion and the second elongated portion.

One or more of the following example features may be included. The golf device may include a hinge securing a first end of the first elongated portion and a first end of the second elongated portion. The arch portion, when the first elongated portion is bent at the hinge from the second elongated portion, may be exposed. The first elongated portion and the second elongated portion may form a 90 degree angle at the hinge. The arch portion may include a first slideable end slideably engageable inside the first elongated portion until a second end of the first elongated portion is reached. The arch portion may include a second slideable end slideably engageable with the second elongated portion until a second end of the second elongated portion is reached. The arch portion, when the first slideable end reaches the second end of the first elongated portion, and when the second slideable end reaches the second end of the second elongated portion, may create a radius with a length from the hinge to the arch portion. The length may be 20 inches. The arch portion may include an arch slide slideably engageable with the first elongated portion, and wherein the second end of the first elongated portion may include a stop. The golf device may include a track, wherein the arch slide may be slideably engageable inside the first elongated portion via the track.

In another example implementation, a golf device may include but is not limited to an elongated portion. The golf device may include a first sub elongated portion recessed in the elongated portion. The golf device may include a second sub elongated portion recessed in the elongated portion. The golf device may include an arch portion slideably engageable inside the first sub elongated portion and the second sub elongated portion.

One or more of the following example features may be included. The golf device may further comprising a hinge securing a first end of the first sub elongated portion and a first end of the second sub elongated portion. The arch portion, when the first sub elongated portion is hinged towards the second sub elongated portion, may be exposed. The first sub elongated portion and the second sub elongated portion may form a 90 degree angle at the hinge. The arch portion may include a first slideable end slideably engageable inside the first sub elongated portion until a second end of the first sub elongated portion is reached. The arch portion may include a second slideable end slideably engageable inside the second sub elongated portion until a second end of the second sub elongated portion is reached. The arch portion, when the first slideable end reaches the second end of the first sub elongated portion, and when the second slideable end reaches the second end of the second sub elongated portion, may create a radius with a length from the hinge to the arch portion. The length may be 20 inches. The arch portion may include an arch slide slideably engageable inside the first sub elongated portion, and wherein the second end of the first sub elongated portion may include a stop. The golf device may further comprise a track, wherein the arch slide may be slideably engageable inside the first sub elongated portion via the track. The golf device may further comprise a first leg secured to the first sub elongated portion via a second hinge, a second track, wherein the first leg may be slideably engageable inside the elongated portion via the second track, a second leg secured to the second sub elongated portion via a third hinge, and a third track, wherein the second leg may be slideably engageable inside the elongated portion via the third track.

In another example implementation, a golf device may include but is not limited to a first elongated portion. The golf device may include a second elongated portion. The golf device may include an arch portion slideably engageable inside the first elongated portion and the second elongated portion.

One or more of the following example features may be included. The golf device may include a hinge securing a first end of the first elongated portion and a first end of the second elongated portion. The arch portion, when pulled from the first elongated portion, may be exposed. The first elongated portion and the second elongated portion may form a 90 degree angle at the hinge. The arch portion may include a first slideable end slideably engageable inside the first elongated portion until a second end of the first elongated portion is reached, and the arch portion may include a second slideable end slideably engageable with the second elongated portion until a second end of the second elongated portion is reached. The arch portion may include a first arch portion and a second arch portion, and the arch portion may include a cavity at a second end of the first arch portion and an insert at a second end of the second arch portion, wherein the cavity at the second end of the first arch portion may be configured to receive the insert at the second end of the second arch portion. The arch portion, when the first slideable end reaches the second end of the first elongated portion, and when the second slideable end reaches the second end of the second elongated portion, and when the cavity at the second end of the first arch portion receives the insert at the second end of the second arch portion, creates a radius with a length from the hinge to the arch portion. The length may be 20 inches. The arch portion may include an arch slide slideably engageable with the first elongated portion, and wherein the second end of the first elongated portion may include a stop. The golf device may include interlocking rings coupled to the keeper and a first end of the arch portion.

In another example implementation, a golf device may include but is not limited to an elongated portion. The golf device may include a sub elongated portion recessed in the elongated portion. The golf device may include an arch portion slideably engageable inside the sub elongated portion.

One or more of the following example features may be included. The golf device may include a hinge securing a first end of the sub elongated portion and the elongated portion. The arch portion, when the sub elongated portion is hinged away from the elongated portion, may be exposed. The sub elongated portion and the elongated portion may form a 90 degree angle at the hinge. The arch portion may be secured to a first end of the elongated portion. The arch portion, when a slideable end of the arch portion reaches a second end of the sub elongated portion, may create a radius with a length from the hinge to the arch portion. The length may be 20 inches. The arch portion may include an arch slide slideably engageable inside the sub elongated portion, and wherein the second end of the sub elongated portion includes a stop. The golf device may further comprise a track, wherein the arch slide may be slideably engageable inside the sub elongated portion via the track.

In another example implementation, a golf device may include but is not limited to an elongated portion. The golf device may include a sub elongated portion recessed in the elongated portion. The golf device may include an arch portion slideably engageable inside the sub elongated portion.

One or more of the following example features may be included. The golf device may include a hinge securing a first end of the sub elongated portion and the elongated portion. The arch portion, when the sub elongated portion is hinged away from the elongated portion, may be exposed. The sub elongated portion and the elongated portion may form a 90 degree angle at the hinge. The arch portion may include a first slideable portion slideably engageable inside the elongated portion and a second slideable portion slideably engageable inside the sub elongated portion. The golf device may include a stop between a first and second end of the elongated portion, wherein the arch portion, when the first slideable portion inside the elongated portion reaches the stop, and when the second slideable portion inside the sub elongated portion reaches a second end of the sub elongated portion, may create a radius with a length from the hinge to the arch portion. The length may be 20 inches. The golf device may include a first track, wherein the arch portion may be slideably engageable inside the sub elongated portion via the first track, and a second track, wherein the arch portion may be slideably engageable inside the elongated portion via the second track.

The details of one or more example implementations are set forth in the accompanying drawings and the description below. Other possible example features and/or possible example advantages will become apparent from the description, the drawings, and the claims. Some implementations may not have those possible example features and/or possible example advantages, and such possible example features and/or possible example advantages may not necessarily be required of some implementations.

BRIEF DESCRIPTION OF THE DRAWINGS

Like reference symbols in the various drawings indicate like elements.

DETAILED DESCRIPTION

Figure 1:
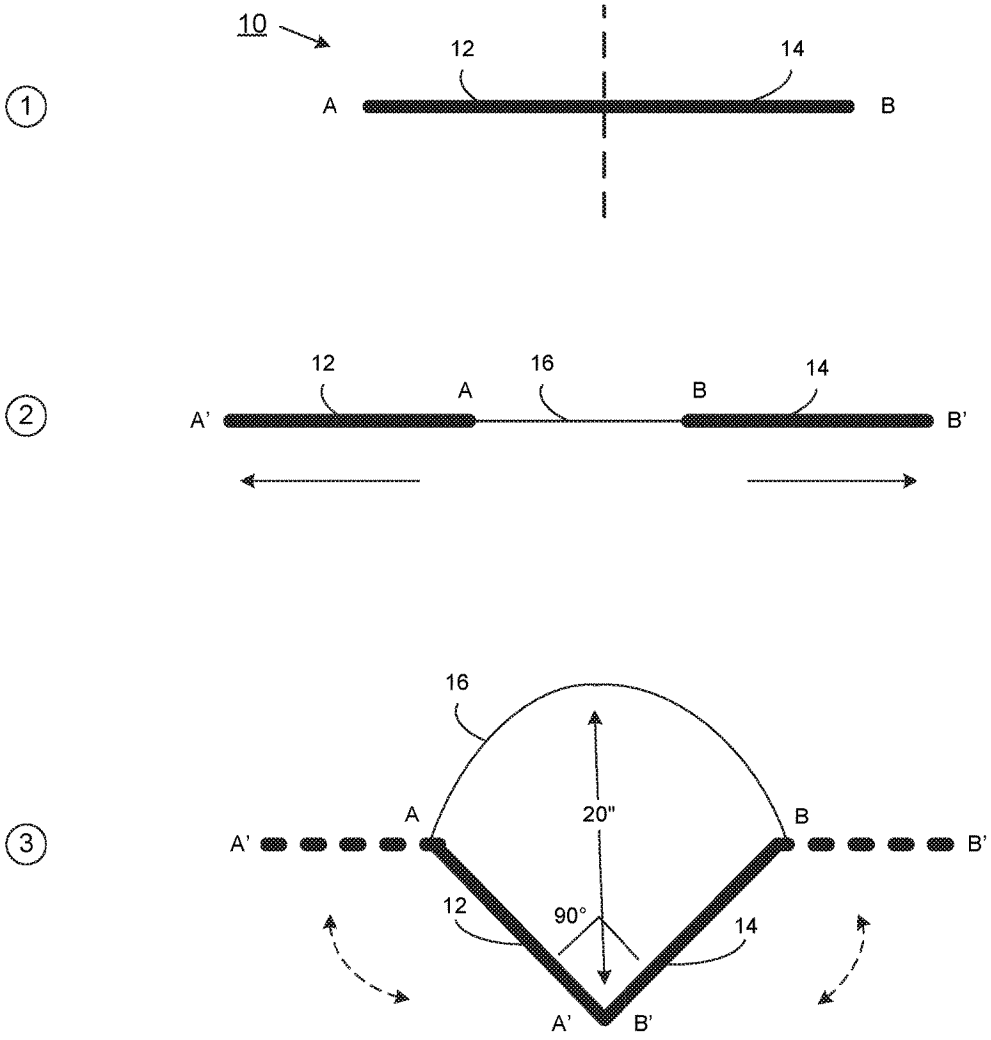
FIG. 1 is an example diagrammatic view of a golf device according to one or more example implementations of the disclosure.

The United States Golf Association (USGA) has proposed a new rule for measuring in certain circumstances the size of the free relief area where a golf ball must be dropped and played, for example, when the previous shot renders the golf ball unplayable (e.g., the golf ball is presenting on an immovable obstruction). For instance, assume for example purposes only that a golfer has hit the ball, which has ended up on an water drain in the course. In the example, the golfer has the option to pick up and drop the ball on a more playable surface (e.g., a free relief area, etc.) using the golf club length as a guide. However, as there may be many additional rules that govern how a ball may be dropped and where a ball may be dropped, questions may arise about whether the ball was dropped near enough to the required drop zone. While the new rule would be to drop a ball anywhere in a relief area measured 20 inches from that spot (but not nearer the cavity), questions may still arise about whether the ball was properly dropped near enough to the required drop zone. With so many clubs and other golfing equipment being stored in a golfer's bag, it may be burdensome to add yet another device. As will be discussed in greater detail, the present disclosure may be used with the new rule to make it simpler for golfers to know where and how to drop a ball by measuring that 20 inch area exactly and quickly, and in some implementations, the present disclosure may be a light weight device that does not take up much room.

In some implementations, the present disclosure may also be used as a convertible golf alignment "stick." For instance, when used as an alignment stick (e.g., before converted to the relief measuring device portion of the disclosure) may be used when warming up as an alignment aid in a variety of ways, For example, players may lay the alignment stick on the ground and point it at their target (creating an intermediate target). As another example, players may place the alignment stick by their feet to make sure their feet are parallel to their target. As another example, players may use two sticks perpendicular to each other to check that their stance is lined up with the ball correctly. As yet another example, players may place the tips of the stick(s) in the ground to create targets. It will be appreciated that the term "stick" should not be used to limit the scope of the disclosure to any particular shape or material.

The Golf Device:

As discussed above and referring also at least to the example implementations of FIGS. 1-11, golf device 10 may include but is not limited to first elongated portion (e.g., first elongated portion 12). Golf device 10 may include a second elongated portion (e.g., second elongated portion 14). Golf device 10 may include an arch portion (arch portion 16) slideably engageable inside first elongated portion 12 and second elongated portion 14.

For instance, and referring at least to example FIG. 1, an example golf device (e.g., golf device 10) is shown. In some implementations, as shown at section (1) of FIG. 1, golf device 10 may be used as a traditional golf alignment stick. For example, as noted above, a player may lay golf device 10 on the ground and point golf device 10 at their target (creating an intermediate target). As another example, a player may place golf device 10 by their feet to make sure the player's feet are parallel to the player's target. As another example, a player may use the first and second elongated portions perpendicular to each other to check that the player's stance is lined up with the ball correctly. As yet another example, a player may place the tips of the elongated portion(s) in the ground to create targets.

In some implementations, golf device 10 may be converted from a golf alignment "stick" into a "relief area" measuring device. For example, in some implementations, and shown at section (1) of FIG. 1, golf device 10 may include first elongated portion (e.g., first elongated portion 12), and in some implementations, golf device 10 may include a second elongated portion (e.g., second elongated portion 14). In the example, first elongated portion 12 and/or second elongated portion 14 may be made from any appropriate material (e.g., fiberglass, plastic, metal, wood, glass, combinations thereof, etc.). In some implementations, first elongated portion 12 and/or second elongated portion 14 may be quarter-round or other size/shape.

In some implementations, as will be discussed below, golf device 10 may include an arch portion (arch portion 16) slideably engageable inside first elongated portion 12 and second elongated portion 14. In some implementations, arch portion 16 may be made from any appropriate flexible material (e.g., steel, stainless steel or other metal, plastic, fiberglass, wood, combinations thereof, etc.). In some implementations, the width of arch portion 16 may be equal to or less than the width of first elongated portion 12 and/or second elongated portion 14, or any other width that may enable arch portion 16 to slideably engage inside first elongated portion 12 and/or second elongated portion 14. In some implementations, the width may be ⅛" diameter flexible polycarbonate rod.

In some implementations, arch portion 16, when first elongated portion 12 is separated from second elongated portion 14, may be exposed. For instance, and referring at least to the example section (2) of FIG. 1, a player (e.g., golfer) may manually separate (e.g., by pulling apart) first elongated portion 12 and second elongated portion 14, thereby exposing arch 16. For example, and referring at least to the example implementation of FIG. 2, golf device 10 may include a securing location (e.g., securing location 18) at first end of the first elongated portion (e.g., A') and a first end of the second elongated portion (e.g., B'). In some implementations, securing location 18 may include a cavity (e.g., cavity 20) at first end A' of the first elongated portion 12 and an insert (e.g., insert 22) at first end B' of the second elongated portion 14, wherein the cavity at first end of the first elongated portion A' may be configured to receive insert 22 at first end of the second elongated portion B'. For instance, assume for example purposes only that when used as an alignment stick (or not in use), first elongated portion 12 and second elongated portion 14 may be secured together with insert 22' inside cavity 20' (aligned parallel with each other). Further assume that the player now wishes to convert golf device 10 from an alignment stick to a drop zone measuring device. In the example, the golfer may manually separate first elongated portion 12 and second elongated portion 14 (e.g., thus removing insert 22' coupled to second elongated portion 14 from cavity 20' of first elongated portion 12), thereby exposing arch 16. The golfer may place insert 22 of second elongated portion 14 into cavity 20 of first elongated portion 12, thereby securing first elongated portion 12 with second elongated portion 14.

It will be appreciated that there may be many different ways to secure first elongated portion 12 with second elongated portion 14 without departing from the scope of the disclosure. For example, first end of first elongated portion A' and first end of the second elongated portion B' may be a magnet and a ferrous material respectively (with or without a protruding insert). As another example, first end of first elongated portion A' and first end of second elongated portion B' may be a hook and loop fastening system, snap on button, spring loaded clip, male/female threads, or other type of technique for securing first end of first elongated portion A' and first end of the second elongated portion B'. As such, the example of using inserts and cavities (including the similar use at A and B of the elongated portions) should be taken as example only and not to otherwise limit the scope of the disclosure.

Figure 2:
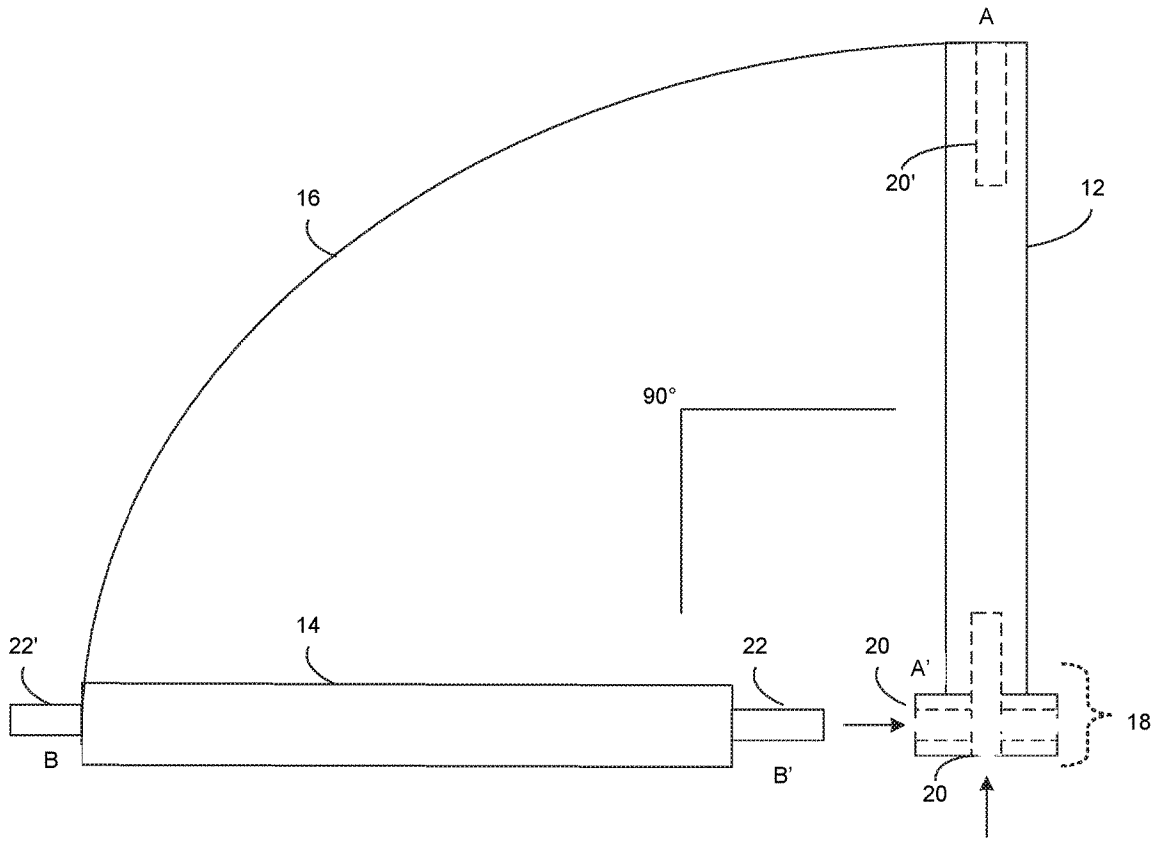
FIG. 2 is an example diagrammatic view of a golf device according to one or more example implementations of the disclosure.

In some implementations, first elongated portion 12 and the second elongated portion 14 may form a 90 degree angle at securing location 18. For instance, as shown in section (3)

of FIG. 1 and also in FIG. 2, when securing first elongated portion 12 with second elongated portion 14, a right angle (90 degrees) may be formed.

In some implementations, arch portion 16 may include a first slideable end slideably engageable inside first elongated portion 12 until a second end of the first elongated portion (e.g., A) is reached, and in some implementations, arch portion 16 may include a keeper slideably engageable with the first elongated portion, wherein the second end of the first elongated portion A may include a stop. For instance, and referring at least to the example implementation of FIG. 3, an example internal view of first elongated portion 12 and second elongated portion 14 is shown. Referring to first elongated portion 12 (above) in FIG. 3, arch portion 16 may include a first slideable end (e.g., keeper 24) coupled to one of its ends. In the example, first elongated portion 12 may include a stop (e.g., stop 26) where arch portion 16 may be exposed/extended from via keeper 24 (as discussed above), which may prevent arch portion 16 from coming completely free of first elongated portion 12 as keeper 24 slides within first elongated portion 12.

Similarly, in some implementations, arch portion 16 may include a second slideable end slideably engageable with the second elongated portion until a second end of the second elongated portion (e.g., B) is reached. For instance, referring to second elongated portion 14 (below) in FIG. 3, arch portion 16 may include a second slideable end (e.g., keeper 24) coupled to one of its ends. In the example, second elongated portion 14 may include a stop (e.g., stop 26) where arch portion 16 may be exposed/extended from via keeper 24 (as discussed above), which may prevent arch portion 16 from coming completely free of second elongated portion 14 as keeper 24 slides within second elongated portion 14. In some implementations, as will be discussed further below in FIG. 9, golf device 10 may include interlocking rings (e.g., interlocking rings 48) coupled to keeper 24 and a first end of the arch portion.

In some implementations, arch portion 16, when the first slideable end reaches the second end of the first elongated portion A, and when the second slideable end reaches the second end of the second elongated portion B, may create a radius with a length from securing location 18 to arch portion 16. For instance, and shown at least at section 3 of FIG. 1, when arch portion 16 is fully exposed/extended and slides (via keeper 24) to contact stop 26 at both the first and second elongated portions respectively, arch portion 26 may bend and create a radius from securing location 18 to arch portion 16. In the example, the player may place the fully extended golf device on the ground at the golf course, with securing location 18 placed in the appropriate location on the ground, e.g., where the ball may be considered in an unplayable lie (e.g., on the edge of a cart path). Thus, in the example, any area within the confines of extended arch portion 16 and first and second elongated portions may be considered an appropriate drop zone location for the player to drop the ball.

In some implementations, the radius with the length from securing location 18 to arch portion 16 may be 20 inches. For instance, the length of first elongated portion 12 may be, e.g., 20 inches, and the length of second elongated portion 14 may be, e.g., 20 inches, thereby resulting in the radius with the length from securing location 18 to arch portion 16 being, e.g., 20 inches, per the above-noted proposed USGA rule. However, it will be appreciated that other lengths may be used without departing from the scope of the disclosure. For example, the length of first elongated portion 12 may be longer or shorter than 20 inches, and the length of second elongated portion 14 may be longer or shorter than 20 inches, thereby resulting in the radius with the length from securing location 18 to arch portion 16 being longer or shorter than 20 inches. As such, the example of having 20 inches as the length should be taken as example only and not to otherwise limit the scope of the disclosure.

In some implementations, as discussed above and also referring also at least to the example implementations of FIGS. 1-11, golf device 10 may include a hinge securing a first end of the first elongated portion and a first end of the second elongated portion. For example, and referring at least to the example implementation of FIG. 4, golf device 10 may include a hinge (e.g., hinge 28) securing first end of the first elongated portion (e.g., A') and a first end of the second elongated portion (e.g., B'). In some implementations, hinge 28 may include any type of hinge (e.g., butt hinge, strap hinge, T-hinge, soss hinge, etc.).

In some implementations, arch portion may include an arch slide slideably engageable with the first elongated portion, golf device 10 may include a track, wherein arch slide 32 may be slideably engageable inside the first elongated portion via the track, where the arch portion, when the first elongated portion is bent at the hinge from the second elongated portion, may be exposed. For instance, assume for example purposes only that when used as an alignment stick (or not in use), first elongated portion 12 and second elongated portion 14 may be aligned parallel with each other (as shown in section (1) in FIG. 4). Further assume that the player now wishes to convert golf device 10 from an alignment stick to a drop zone measuring device.

In the example, the golfer may manually bend first elongated portion 12 and second elongated portion 14 at hinge 28, thereby exposing arch 16 at least partially. For instance, and referring at least to the example section (2) of FIG. 4, a player (e.g., golfer) may manually bend first elongated portion 12 and second elongated portion 14 at hinge 28. In some implementations, continuing with the above example and also referring at least to the example implementation of FIG. 5, an example track (e.g., track 30) is shown at an end view of first elongated portion 12. In the example, arch portion 16 (e.g., via arch slide 32) may fit within track 30, which may be a hollowed out portion of first elongated portion 12 in some implementations. As a result, arch portion 16 (e.g., via arch slide 32) may be forced (or manually slid) up and down first elongated portion 12 as the elongated portions are bent at hinge 28, thereby extending and retracting arch portion 16 (and therefore the length of arch portion 16). In some implementations, a similar approach may be used for second elongated portion 12. That is, in the example, arch portion 16 (e.g., via arch slide 32) may fit within track 30, which may be a hollowed out portion of second elongated portion 14 in some implementations. As a result, arch portion 16 (e.g., via arch slide 32) may be forced (or manually slid) up and down second elongated portion 14 as the elongated portions are bent at hinge 28, thereby extending and retracting arch portion 16 (and therefore the radius length of arch portion 16).

In some implementations, as similarly noted above, first elongated portion 12 and second elongated portion 14 may form a 90 degree angle at hinge 28. For instance, as shown in section (3) of FIG. 4, when bending first elongated portion 12 with second elongated portion 14 at hinge 28, a right angle (90 degrees) eventually may be formed.

In some implementations, as similarly noted above, arch portion 16, when the first slideable end reaches the second end of the first elongated portion, and when the second slideable end reaches the second end of the second elongated portion, may create a radius with a length from the hinge to the arch portion. In the example, when the first elongated portion and the second elongated portion are 20" long, the length of the radius will also be 20". For instance, and shown at least at section (3) of FIG. 4, when arch portion 16 is fully exposed and slides (via bent hinge 28, arch slide 32, and track 30) to both ends AB of the first and second elongated portions respectively, arch portion 26 may bend and create a radius from hinge 28 to arch portion 16. In the example, the player may place the fully extended golf device on the ground at the golf course, with hinge 28 placed in the appropriate location on the ground, e.g., where the ball may be considered in an unplayable lie (e.g., on the edge of a cart path). Thus, in the example, any area within the confines of extended arch portion 16 and first and second elongated portions may be considered an appropriate drop zone location for the player to drop the ball.

As discussed above and referring also at least to the example implementations of FIGS. 1-11, golf device 10 may include but is not limited to an elongated portion (e.g., elongated portion 34). Golf device 10 may include a first sub elongated portion (e.g., first sub elongated portion 36) recessed in elongated portion 34. Golf device 10 may include a second sub elongated portion (e.g., second sub elongated portion 38) recessed in elongated portion 34. Golf device may include an arch portion (e.g., arch portion 16) slideably engageable inside first sub elongated portion 36 and second sub elongated portion 38.

Figure 6:
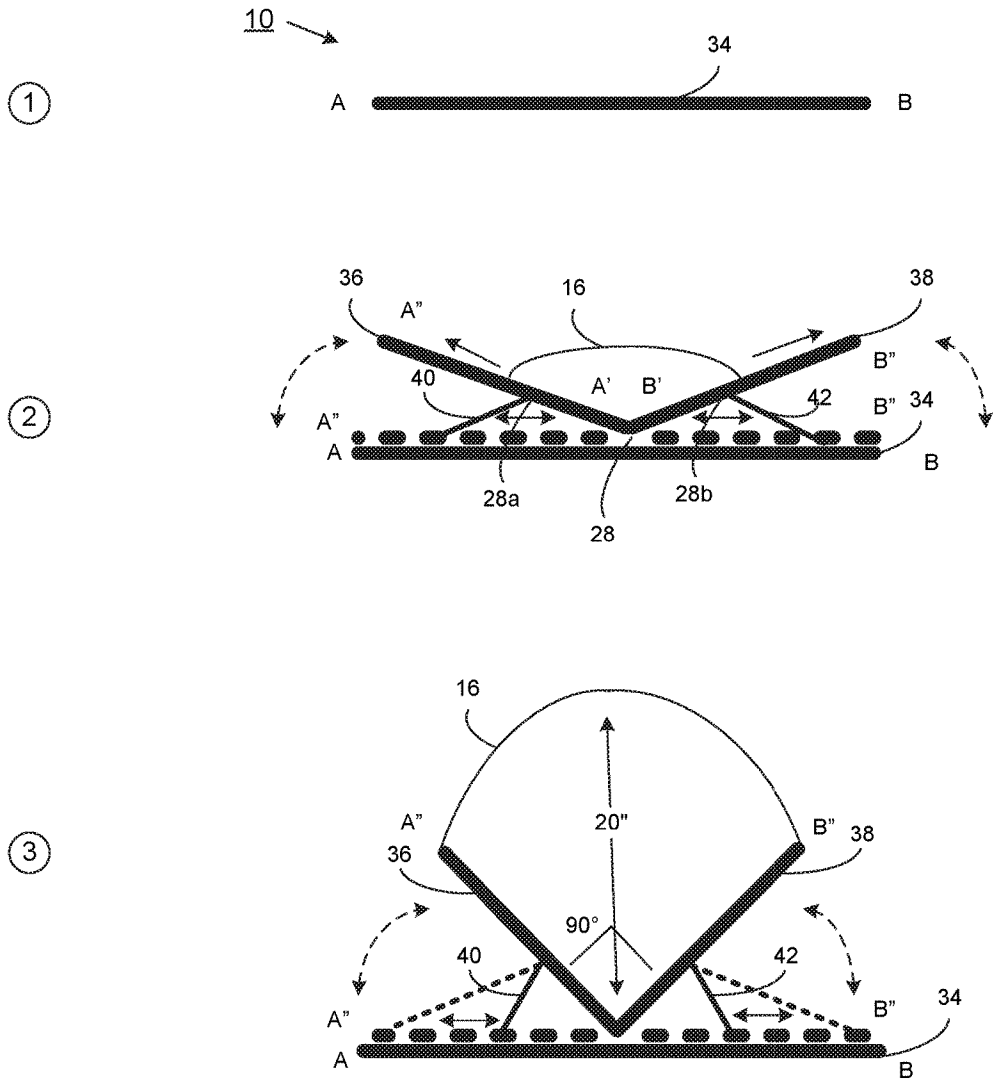
FIG. 6 is an example diagrammatic view of a golf device according to one or more example implementations of the disclosure.

For instance, assume for example purposes only that when used as an alignment stick (or not in use), each of the elements recessed in elongated portion 34 are aligned with each other (as shown in section (1) in FIG. 6). Further assume that the player now wishes to convert golf device 10 from an alignment stick to a drop zone measuring device.

In the example, and in some implementations, golf device 10 may include a hinge (e.g., hinge 28) securing a first end (A') of first sub elongated portion 36 and a first end (B') of second sub elongated portion 38. Thus, in the example, the golfer may manually bend first sub elongated portion 36 and second sub elongated portion 38 at hinge 28, thereby exposing arch 16 at least partially (as similarly discussed throughout). For instance, and referring at least to the example section (2) of FIG. 6, a player (e.g., golfer) may manually bend first sub elongated portion 36 and second sub elongated portion 38 at hinge 28. In some implementations, continuing with the above example and also referring at least to the example implementation of FIG. 7, an example track (e.g., track 30) is shown at an end view of first sub elongated portion 36. In the example, arch portion 16 (e.g., via arch slide 32) may fit within track 30, which may be a hollowed out portion of first sub elongated portion 36 in some implementations. As a result, arch portion 16 (e.g., via arch slide 32) may be forced (or manually slid) up and down first sub elongated portion 36 as the elongated portions are bent at hinge 28, thereby extending and retracting arch portion 16 (and therefore the length of arch portion 16). In some implementations, a similar approach may be used for second sub elongated portion 38. That is, in the example, arch portion 16 (e.g., via arch slide 32) may fit within track 30, which may be a hollowed out portion of second sub elongated portion 38 in some implementations. As a result, arch portion 16 (e.g., via arch slide 32) may be forced (or manually slid) up and down second sub elongated portion 38 as the elongated portions are bent at hinge 28, thereby extending and retracting arch portion 16 (and therefore the radius length of arch portion 16). It will be appreciated that the example sub elongated shapes shown in FIG. 7 may be any appropriate shape without departing from the scope of the disclosure.

In some implementations, as similarly noted above, first sub elongated portion 36 and second sub elongated portion 38 may form a 90 degree angle at hinge 28. For instance, as shown in section (3) of FIG. 6, when bending first sub elongated portion 36 with second sub elongated portion 38 at hinge 28, a right angle (90 degrees) eventually may be formed.

In some implementations, as similarly noted above, arch portion 16, when first slideable end reaches the second end of the first sub elongated portion, and when the second slideable end reaches the second end of the second sub elongated portion, may create a radius with a length from the hinge to the arch portion. In the example, the radius is 20", but it will be appreciated that other lengths may be used. For instance, and shown at least at section (3) of FIG. 6, when arch portion 16 is fully exposed and slides (via the combination of first sub elongated portion 36, second sub elongated portion 38, bent hinge 28, arch slide 32, and track 30) to both ends A"/B" of the first and second sub elongated portions respectively, arch portion 26 may bend and create a radius from hinge 28 to arch portion 16. In the example, the player may place the fully extended golf device on the ground at the golf course, with hinge 28 placed in the appropriate location on the ground, e.g., where the ball may be considered in an unplayable lie (e.g., on the edge of a cart path). Thus, in the example, any area within the confines of extended arch portion 16 and first and second elongated portions may be considered an appropriate drop zone location for the player to drop the ball.

Figure 7:
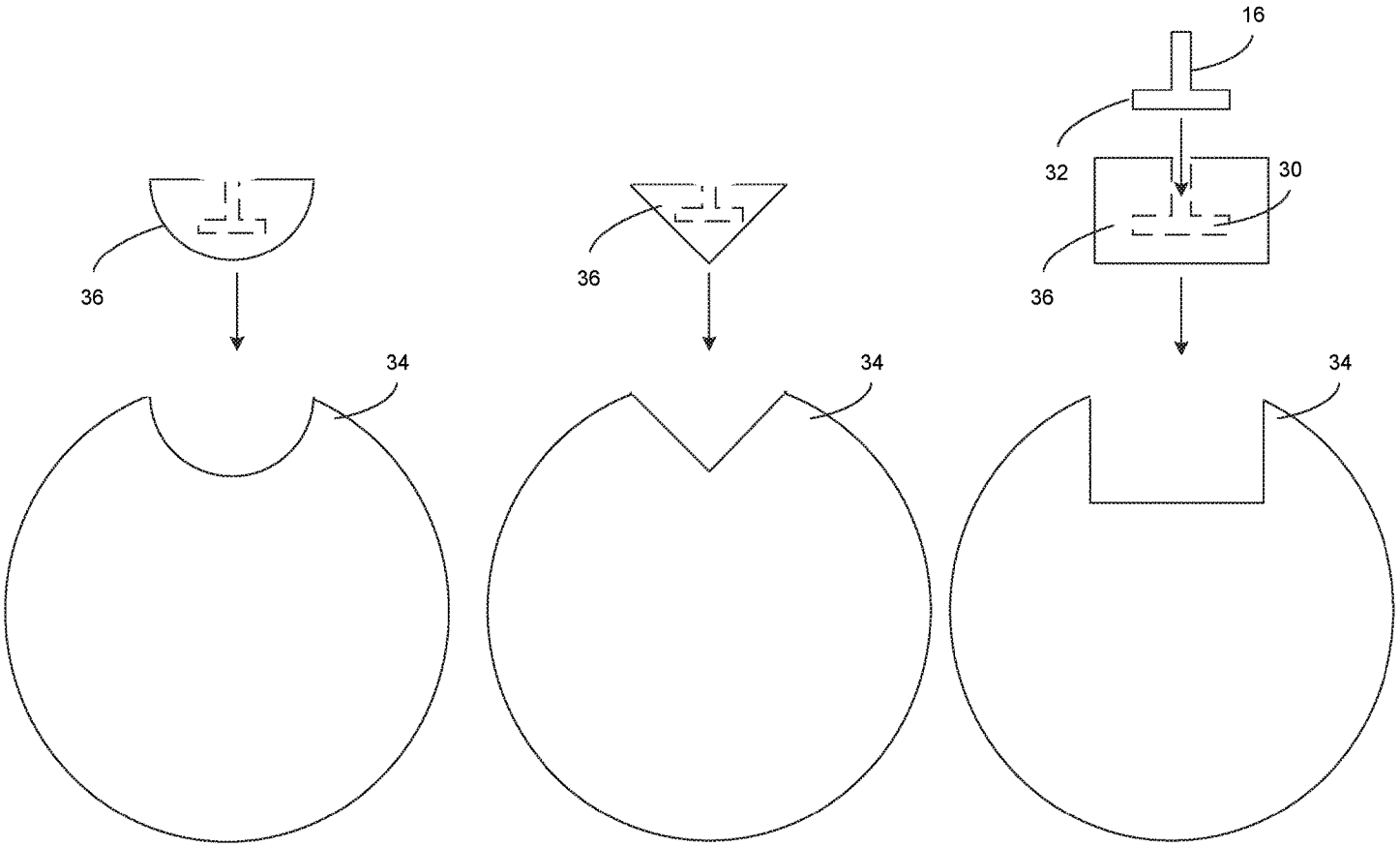
FIG. 7 is an example diagrammatic view of a golf device according to one or more example implementations of the disclosure.
Figure 8:
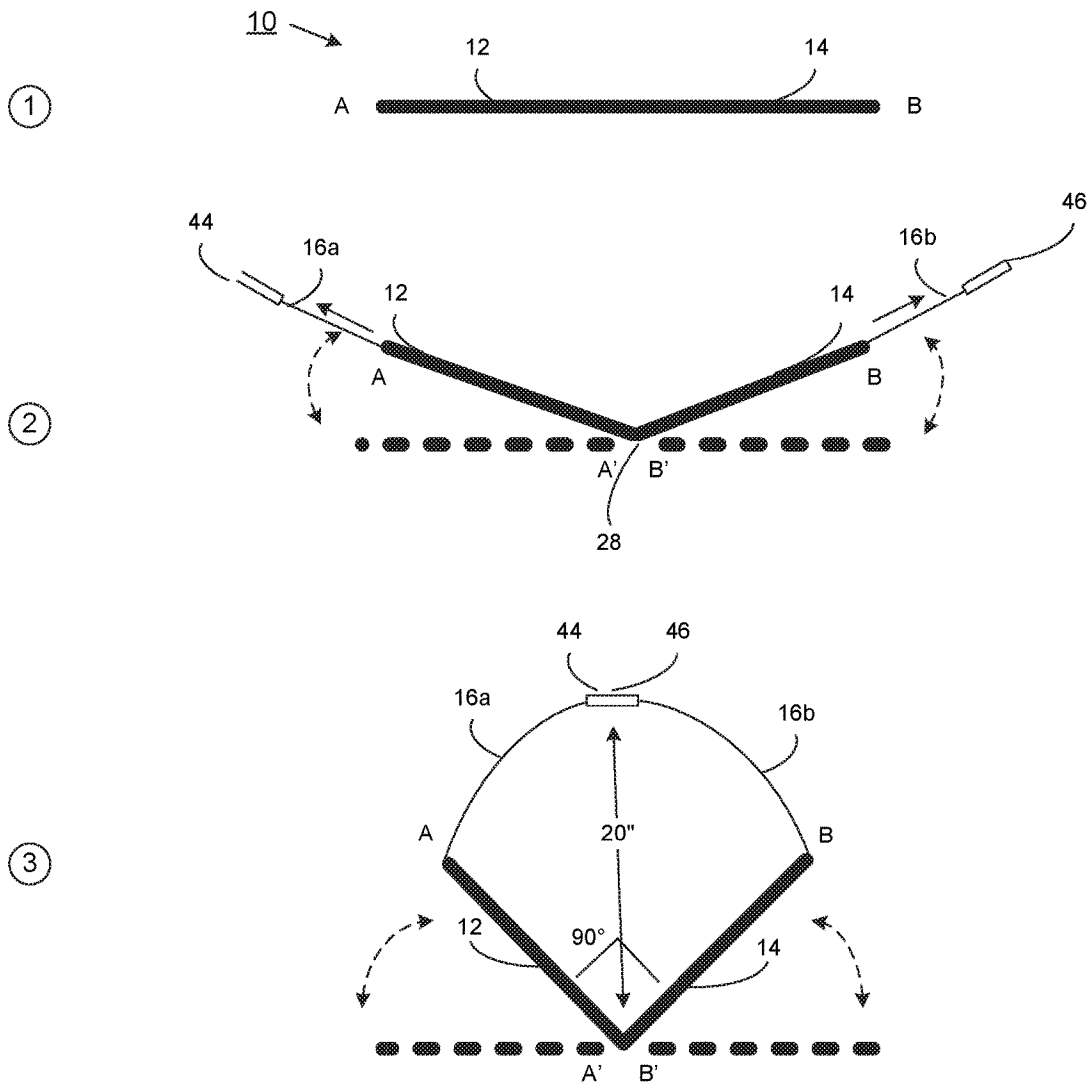
FIG. 8 is an example diagrammatic view of a golf device according to one or more example implementations of the disclosure.
Figure 9:
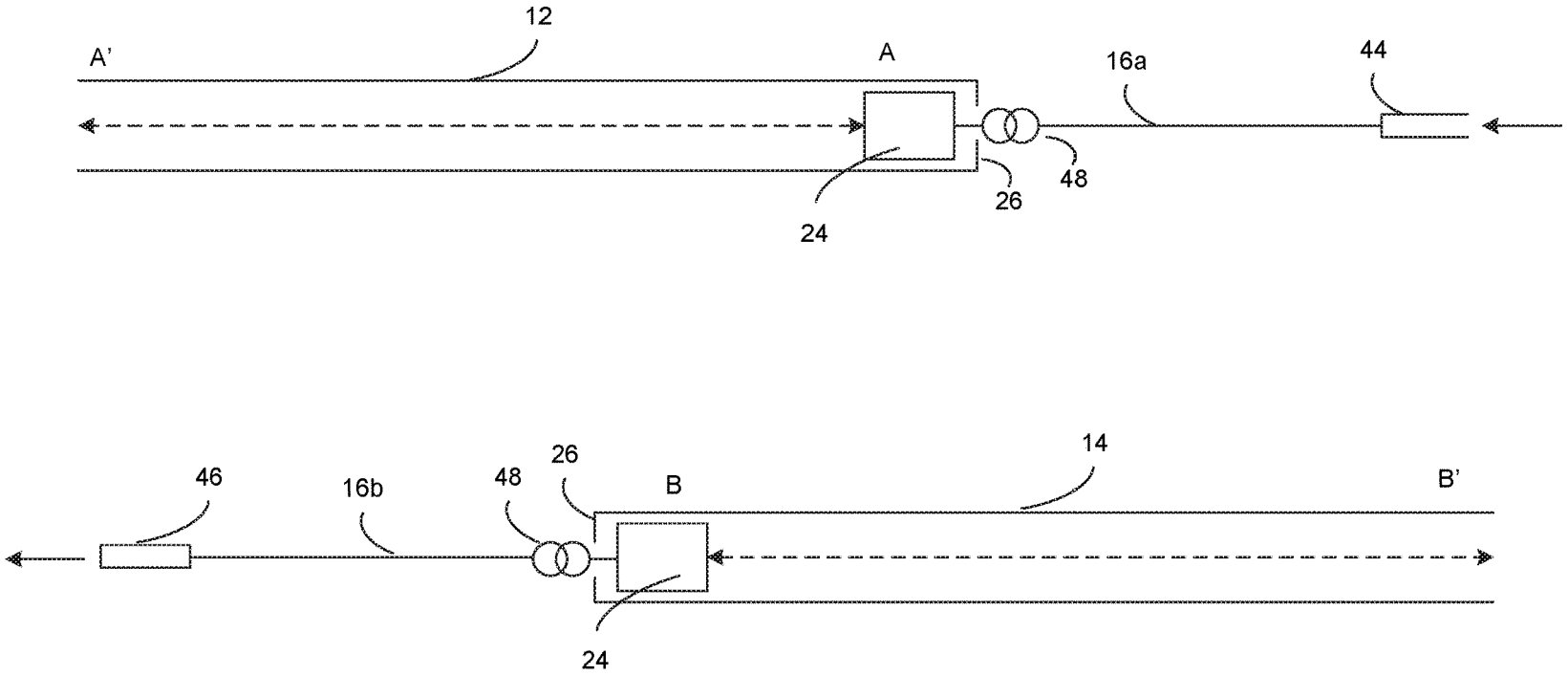
FIG. 9 is an example diagrammatic view of a golf device according to one or more example implementations of the disclosure.

In some implementations, golf device 10 may include sub elongated portion locks (e.g., to keep the sub elongated portions from collapsing back on their own). For instance, in some implementations, and referring at least to sections (2) and (3) of FIG. 6, golf device 10 may include a first leg (e.g., first leg 40) secured to first sub elongated portion 36 via a second hinge (e.g., hinge 28*a*), a second track, wherein first leg 40 may be slideably engageable inside elongated portion 34 via the second track, a second leg (e.g., second leg 42) secured to second sub elongated portion 38 via a third hinge (e.g., hinge 28*b*), and a third track, wherein second leg 42 may be slideably engageable inside elongated portion 34 via the third track. For example, similar to the example track implementation of FIG. 5, elongated portion 34 may have a track extending the length of elongated portion 34 (e.g., with a length long enough to accommodate both legs for each side respectively) or may have two separate tracks on each side of elongated portion 34 to accommodate each leg respectively. In the example, first leg (e.g., via arch slide 32 or leg slide 32 when used with a leg) may fit within track 30, which may be a hollowed out portion of elongated portion 34 in some implementations, or may be a similar implementation as shown in FIG. 7. As a result, each leg (e.g., via leg slide 32) may be forced (or manually slid) up and down elongated portion 34 as the sub elongated portions are bent at hinge 28 and legs are bent at hinges 28*a/b* respectively. In the example, once fully extended (or a 90 degree angle is reached with sub elongated portions 36/38, legs 40/42 may be "locked" or otherwise prevented from slipping back to the alignment stick orientation, similar to gas-pump trigger lock mechanisms for fuel pump nozzles. It will be appreciated that other locking mechanisms may be used without departing form the scope of the disclosure, such as, e.g., a magnet, a pin/spring, or any other locking mechanism.

Figure 3:
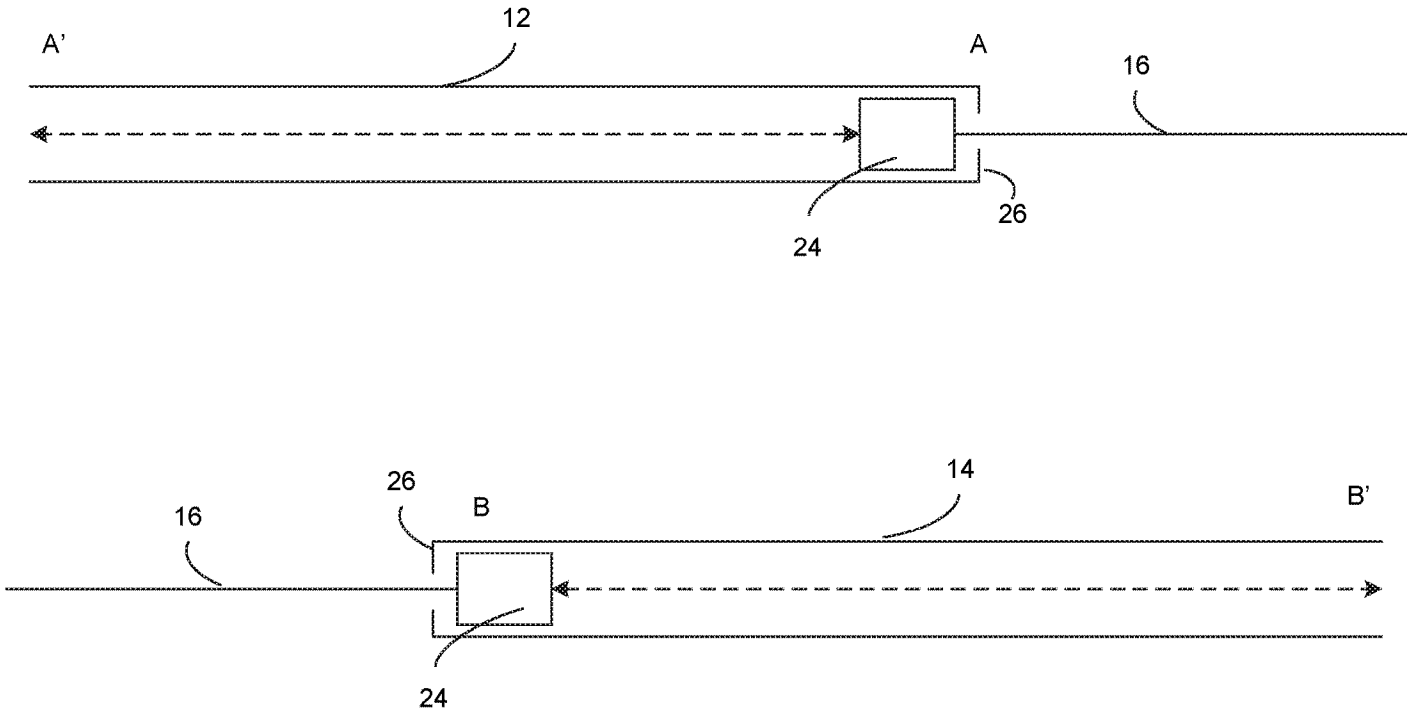
FIG. 3 is an example diagrammatic view of a golf device according to one or more example implementations of the disclosure.
Figure 4:
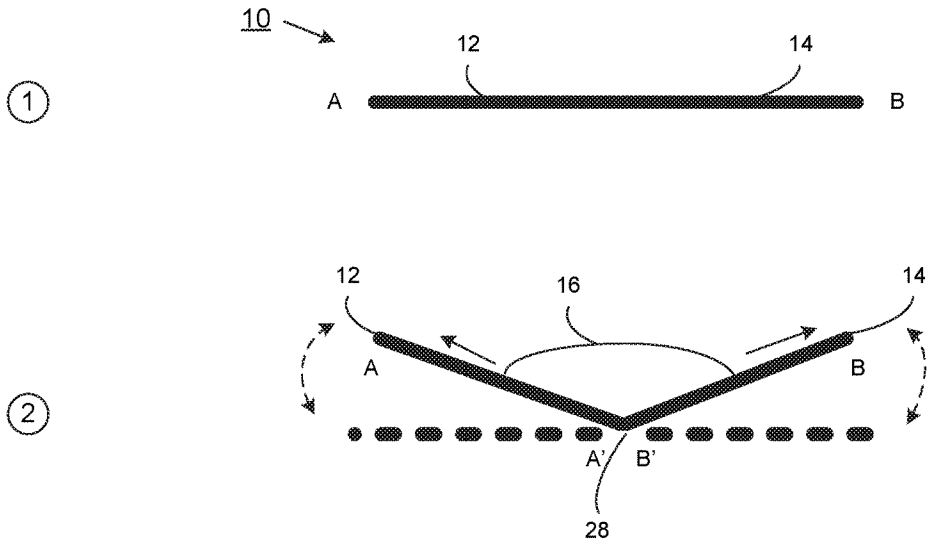
FIG. 4 is an example diagrammatic view of a golf device according to one or more example implementations of the disclosure.
Figure 5:
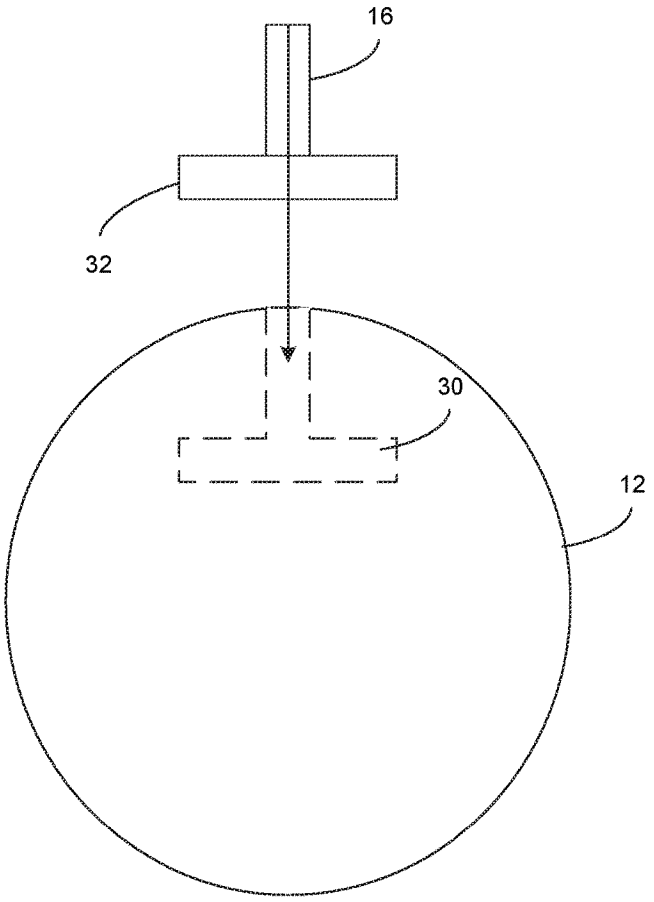
FIG. 5 is an example diagrammatic view of a golf device according to one or more example implementations of the disclosure.

As discussed above and referring also at least to the example implementations of FIGS. 1-11, golf device 10 may be similar to the example implementation of FIGS. 3 and 4 with one or more modification, variations, and/or substitutions.

For example, in some implementations, arch portion 16, when pulled from first elongated portion 12, may be exposed, and similarly, arch portion 16, when pulled from second elongated portion 14, may be exposed. For instance, assume for example purposes only, and referring at least to the example implementation of FIGS. 8 and 9, that a similar slideable keeper 24 and stop 26 implementation is used for arch portion 16. In the example, arch portion 16 may include a first arch portion (e.g., first arch portion 16*a*) and a second arch portion (e.g., second arch portion 16*b*). In the example, first arch portion 16*a*, when manually pulled from first elongated portion 12, may be exposed, and similarly, second arch portion 16*b*, when manually pulled from second elongated portion 14, may be exposed. Similar to the example implementation of FIG. 4, golf device 10 may include a hinge (e.g., hinge 28) securing first end of the first elongated portion (e.g., A') and a first end of the second elongated portion (e.g., B'). When bending first elongated portion 12 with second elongated portion 14 at hinge 28, a right angle (90 degrees) eventually may be formed.

In some implementations, arch portion 16 may include a cavity (e.g., cavity 44) at a second end of first arch portion 16*a* (e.g., the portion pulled from first elongated portion 12 at A), and an insert (e.g., insert 46) at a second end of second arch portion 16*b* (e.g., the portion pulled from second elongated portion 14 at B). In the example, cavity 44 at the second end of first arch portion 16*a* may be configured to receive insert 46 at the second end of second arch portion 16*b*. As a result, when bending first elongated portion 12 with second elongated portion 14 at hinge 28, and when the first slideable end reaches the second end of the first elongated portion, and when the second slideable end reaches the second end of the second elongated portion, and when coupling first arch portion 16*a* and second arch portion 16*b* via cavity 44 and insert 46 respectively, a radius may be created with a length (e.g., 20 inches) from the hinge to the coupling of first and second arch portion 16*a*/16*b* (e.g., shown at least at section (3) of FIG. 8).

In some implementations, golf device 10 may include interlocking rings (e.g., interlocking rings 48) coupled to keeper 24 and a first end of the arch portion. For instance, and referring at least to the example implementation of FIG. 9, the interlocking rings 48 together may create a universal joint, allowing the arch to be angled 90 degrees (e.g., in any direction) to the elongated portions. Interlocking rings 48 may also be loops formed on the ends of the first and second elongated portions. In some implementations, a true universal joint, such as those used at either end of an automobile drive shaft, may be used. In some implementations, interlocking rings 48 may enable first arch portion 16*a* and second arch portion 16*b* to move to a right angle of their first and second respective elongated portions. In some implementations, a hinge may be used instead of interlocking rings 48 (and vice versa).

It will be appreciated that there may be many different ways to connect first arch portion 16*a* and second arch portion 16*b* without departing from the scope of the disclosure. For example, cavity 44 and insert 46 may be a magnet and a ferrous material respectively. As another example, cavity 44 and insert 46 may be a hook and loop fastening system, snap on button, male/female threads, a separate clip device that would hold the ends together, or other type of technique for coupling cavity 44 and insert 46.

As discussed above and referring also at least to the example implementations of FIGS. 1-11, golf device 10 may be similar to the example implementation of FIGS. 6 and 7 with one or more modification, variations, and/or substitutions.

Figure 10:
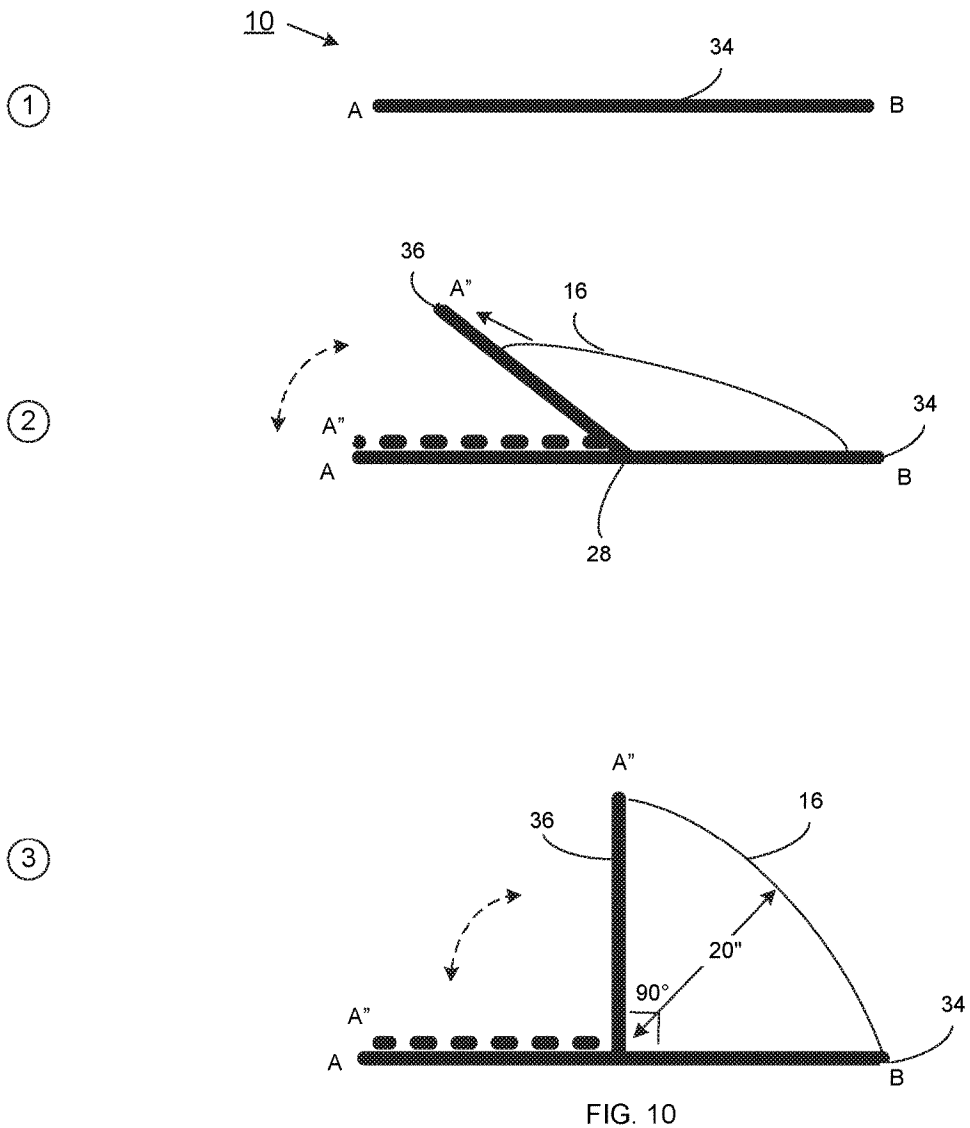
FIG. 10 is an example diagrammatic view of a golf device according to one or more example implementations of the disclosure.
Figure 11:
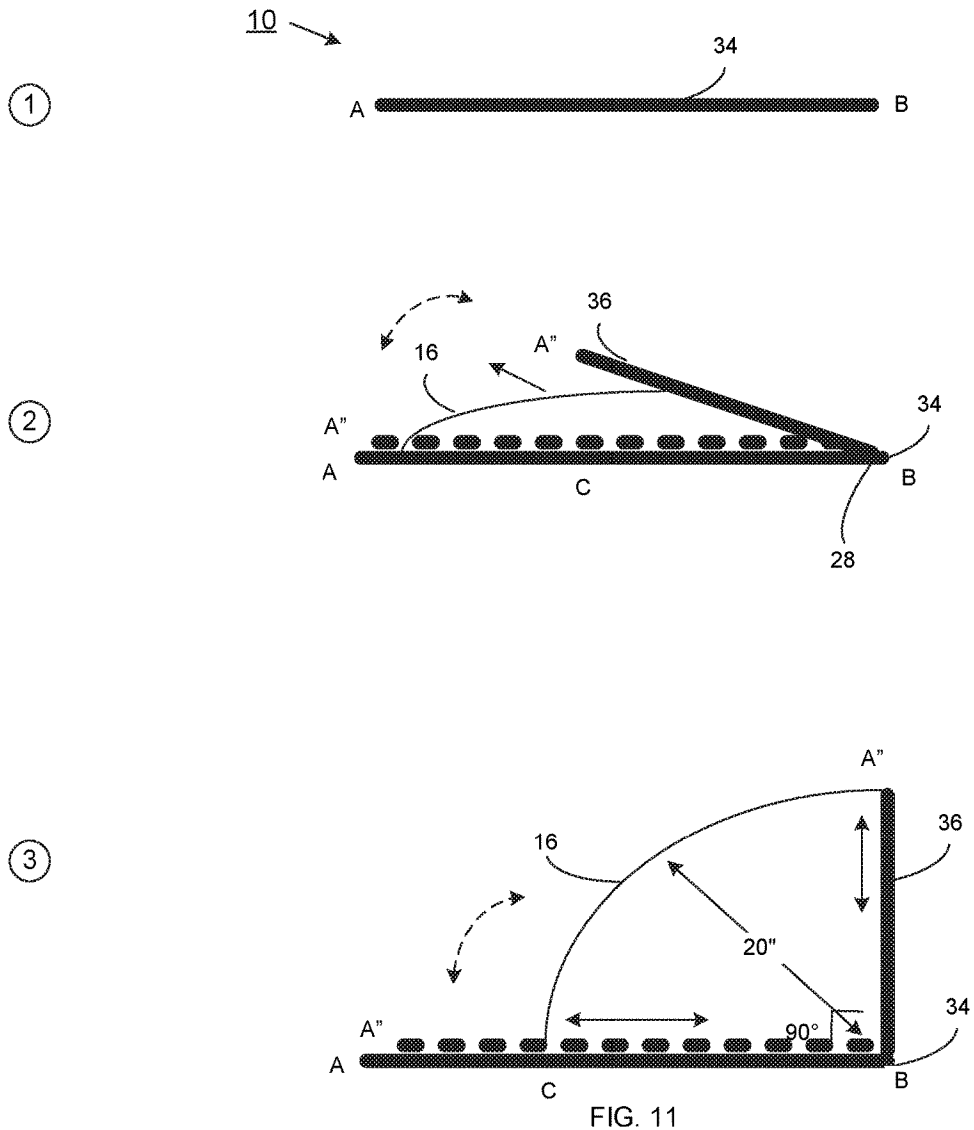
FIG. 11 is an example diagrammatic view of a golf device according to one or more example implementations of the disclosure.

For example, while the example implementation of FIG. 6 may include symmetrical first sub elongated portion 36 and second sub elongated portion 38 bendable at hinge 28, the example implementation of FIG. 10 may eliminate the need for second sub elongated portion 38 (and its associated elements). For example, golf device 10 may include elongated portion 34, sub elongated portion 36 recessed in elongated portion 34, and arch portion 16 slideably engageable inside sub elongated portion 36. In the example, hinge 28 may secure a first end of sub elongated portion 36 and elongated portion 34, such that arch portion 16, when sub elongated portion 36 is hinged away from elongated portion 34, may be exposed (e.g., similarly as discussed above with FIGS. 6 and 7).

As another example variation, arch portion may be secured to a first end of elongated portion 34 (e.g., B), such that arch portion 16, when a slideable end of the arch portion reaches a second end A" of sub elongated portion 36, may create a radius with a length from hinge 28 to arch portion 16. As another example variation, leg 40 and its associated elements may be optional.

As discussed above and referring also at least to the example implementations of FIGS. 1-11, golf device 10 may be similar to the example implementation of FIGS. 7 and 10 with one or more modification, variations, and/or substitutions.

For example, similar to the example implementation of FIG. 10, golf device 10 may include elongated portion 34, sub elongated portion 36 recessed in elongated portion 34, and arch portion 16 slideably engageable inside sub elongated portion 36. In the example, hinge 28 may secure a first end of sub elongated portion 36 and end B of elongated portion 34, such that arch portion 16, when sub elongated portion 36 is hinged away from elongated portion 34, may be exposed (e.g., similarly as discussed above with FIGS. 6 and 7).

In some implementations, arch portion 16 may include a first slideable portion slideably engageable inside elongated portion 34 and a second slideable portion slideably engageable inside sub elongated portion 36. In some implementations, golf device 10 may include a stop between a first and second end of elongated portion 34 (e.g., at location C), wherein arch portion 16, when the first slideable portion inside the elongated portion reaches the stop, and when the second slideable portion inside sub elongated portion 36 reaches a second end A" of sub elongated portion 36, may create a radius with a length (e.g., 20") from hinge 28 to arch 16.

In some implementations, golf device 10 may include a first track (similar to the above-noted tracks of FIGS. 5 and 7), wherein arch portion 16 may be slideably engageable inside sub elongated portion 36 via the first track, and a second track, wherein arch portion 16 may be slideably engageable inside elongated portion 34 via the second track. Thus, in the example, arch portion 16 may have one end slideably engageable inside sub elongated portion 36 (e.g., via the first track), and may have a second end slideably engageable inside elongated portion 34 (e.g., via the second track).

As will be clear from the present disclosure, and as discussed throughout, any of the above-noted implementations may be used in any combination, substitution, and modification, to create other implementations without departing from the scope of the disclosure. As an example, implementations with tracks may instead be utilized with the keeper and stop implementations. As another example, implementations with legs may be utilized without legs (and vice versa). As yet another example, implementations with sub elongated portions may be used with more or less sub elongated portions (including no sub elongated portions). As such, the example implementations described should be taken as example only, and not to otherwise limit the scope of the disclosure.

The terminology used herein is for the purpose of describing particular implementations only and is not intended to be limiting of the disclosure. As used herein, the singular forms "a", "an" and "the" are intended to include the plural forms as well, unless the context clearly indicates otherwise. As used herein, the language "at least one of A, B, and C" (and the like) should be interpreted as covering only A, only B, only C, or any combination of the three, unless the context clearly indicates otherwise. It will be further understood that the terms "comprises" and/or "comprising," when used in this specification, specify the presence of stated features, integers, steps (not necessarily in a particular order), elements, and/or components, but do not preclude the presence or addition of one or more other features, integers, steps (not necessarily in a particular order), elements, components, and/or groups thereof.

The corresponding structures, materials, acts, and equivalents that may be in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications, variations, substitutions, and any combinations thereof will be apparent to those of ordinary skill in the art without departing from the scope and spirit of the disclosure. The implementation(s) were chosen and described in order to explain the principles of the disclosure and the practical application, and to enable others of ordinary skill in the art to understand the disclosure for various implementation(s) with various modifications and/or any combinations of implementation(s) as are suited to the particular use contemplated.

Having thus described the disclosure of the present application in detail and by reference to implementation(s) thereof, it will be apparent that modifications, variations, and any combinations of implementation(s) (including any modifications, variations, substitutions, and combinations thereof) are possible without departing from the scope of the disclosure defined in the appended claims.

What is claimed is:

1. A golf device comprising:

a first elongated portion including a hollow portion, a first end, and a second end, wherein the first elongated portion and the hollow portion are straight;

a second elongated portion including a hollow portion, a first end, and a second end, wherein the second elongated portion and the hollow portion are straight, and wherein the first elongated portion and the second elongated portion are configured to be coupled together at their second ends at an angle of 180 degrees;

a securing location at the first end of the first elongated portion and the first end of the second elongated portion to secure the first elongated portion to the second elongated portion at a 90 degree angle, wherein the securing location includes a cavity at the first end of the first elongated portion and an insert at the first end of the second elongated portion, wherein the cavity at the first end of the first elongated portion is configured to receive the insert at the first end of the second elongated portion; and an arch portion, which is made from a flexible material, concealed inside the hollow portions while the first elongated portion and the second elongated portion are coupled together at their second ends at the angle of 180 degrees, wherein the arch portion includes a first slideable end which is slideably engageable inside the first elongated portion in a lengthwise direction of the first elongated portion until reaching the second end of the first elongated portion, wherein the arch portion includes a second slideable end which is slideably engageable inside the second elongated portion in a lengthwise direction of the second elongated portion until reaching the second end of the second elongated portion, wherein the arch portion is exposed outside of the first elongated portion and the second elongated portion as a result of the second end of the first elongated portion being separated from the second end of the second elongated portion in the lengthwise direction of the first and second elongated portions; wherein the arch portion forms an arch from the second end of the first elongated portion to the second end of the second elongated portion when the first slideable end reaches the second end of the first elongated portion, when the second slideable end reaches the second end of the second elongated portion, and when the first end of the first elongated portion is coupled to the first end of the second elongated portion at the 90 degree angle at the securing location, the arch having a radius with a length from the securing location to the arch portion.

2. The golf device of claim 1 wherein the length is 20 inches.

3. The golf device of claim 1 wherein the arch portion includes a keeper slideably engageable inside the first elongated portion, and wherein a second end of the first elongated portion includes a stop.

4. The golf device of claim 3 further comprising interlocking rings coupling the keeper to the arch portion.

* * * * *